US006981531B1

(12) United States Patent
Palazzo

(10) Patent No.: US 6,981,531 B1
(45) Date of Patent: Jan. 3, 2006

(54) METHOD AND APPARATUS FOR WASTE OIL MANAGEMENT

(75) Inventor: John W. Palazzo, Akron, OH (US)

(73) Assignee: Frontline International, Inc., Akron, OH (US)

( * ) Notice: Subject to any disclaimer, the term of this patent is extended or adjusted under 35 U.S.C. 154(b) by 0 days.

(21) Appl. No.: 10/719,499

(22) Filed: Nov. 21, 2003

Related U.S. Application Data

(63) Continuation-in-part of application No. 10/664,650, filed on Sep. 19, 2003, now abandoned.

(60) Provisional application No. 60/412,089, filed on Sep. 19, 2002, provisional application No. 60/517,330, filed on Nov. 4, 2003.

(51) Int. Cl.
*B65B 1/30* (2006.01)

(52) U.S. Cl. ..... 141/95; 141/98; 141/198; 141/231

(58) Field of Classification Search ..... 141/82, 141/95, 96, 98, 198, 231; 99/403
See application file for complete search history.

(56) References Cited

U.S. PATENT DOCUMENTS

| | | | | |
|---|---|---|---|---|
| 3,586,822 A | * | 6/1971 | Pastore | 392/494 |
| 3,866,472 A | | 2/1975 | Witt | |
| 4,508,026 A | | 4/1985 | Anetsberger et al. | |
| 4,646,793 A | | 3/1987 | Sherratt | |
| 5,159,962 A | * | 11/1992 | Dow | 141/98 |
| 5,249,511 A | | 10/1993 | Shumate et al. | |
| 5,586,486 A | * | 12/1996 | Nitschke et al. | 99/330 |
| 6,157,776 A | | 12/2000 | Onken | |

* cited by examiner

*Primary Examiner*—Justine R. Yu
*Assistant Examiner*—Peter deVore
(74) *Attorney, Agent, or Firm*—Brouse McDowell; Roger D. Emerson; Daniel A. Thomson

(57) ABSTRACT

A new and improved waste oil management system is described herein. A remote storage tank, with a control panel and a pumping mechanism is connected to a fryer via metal tubing. The used oil is pumped from the fryer directly to the storage tank. In another embodiment of the system, a storage caddy, equipped with a filtration system, is used to transport the used oil from the fryer to the storage tank.

7 Claims, 12 Drawing Sheets

METHOD AND APPARATUS FOR WASTE OIL MANAGEMENT

This application claims the benefit of U.S. Provisional application Ser. No. 60/517,330, filed Nov. 4, 2003, and is a continuation-in-part of application Ser. No. 10/664,650, filed Sep. 19, 2003, now abandoned, which claims the benefit of U.S. Provisional application Ser. No. 60/412,089, entitled Method and Apparatus for Waste Oil Management, filed Sep. 19, 2002.

I. BACKGROUND OF THE INVENTION

A. Field of Invention

This invention relates to the art of waste oil management and collection, and particularly to a system for collecting and storing spent cooking oil.

B. Description of the Related Art

Currently, waste oil is stored in drums or other temporary receptacles, often outside the back door of the premises. This presents an unsightly and dangerous hazard, which is compounded by spills causing slippery areas that are almost impossible to clear, creating odors and mess.

The present invention provides a new and improved waste oil management system, and overcomes certain difficulties inherent in the related inventions while providing better overall results.

II. SUMMARY OF THE INVENTION

In accordance with one aspect of the present invention, a waste oil management system for use with multiple associated fryers includes a remote oil holding tank, the tank being located in a different room than the fryers, stainless steel tubing, the tubing being coated interiorally with a non-stick coating, the tubing connecting the fryers to the tank, and at least one pumping mechanism, the pumping mechanism enabling used oil to be transported from the fryer to the tank.

In accordance with another aspect of the present invention, a waste oil management system for use with at least one associated food grade oil utilizing apparatus includes at least one remote oil holding tank, transport tubing, the tubing connecting the apparatus to the tank, and transferring means for transferring used oil through the tubing from the apparatus to the tank.

In accordance with another aspect of the present invention, the transport tubing has non-stick interior coating.

In accordance with another aspect of the present invention, the transferring means is a pumping mechanism.

In accordance with another aspect of the present invention, a waste oil storage caddy includes a first container, a second container for holding filtered oil, a motor, a pump, a handle, a power cord, first tubing, the first tubing connected to the motor and the first container, second tubing, the second tubing connected to the motor and the second container, and a filter.

In accordance with another aspect of the present invention, the caddy further comprises wheels.

In accordance with another aspect of the present invention, the first tubing is flexible tubing.

In accordance with another aspect of the present invention, the power cord is detachable.

In accordance with another aspect of the present invention, an oil containment device includes a top, a bottom, a body, an oil level measurement device, an oil shut-off device, the shut-off device connected to the containment device, and a control panel, the control panel including a display monitor, the monitor displaying the oil level in the containment device, means for relaying a shut-off signal to the oil shut-off device, and a power supply.

In accordance with another aspect of the present invention, the control panel further includes means for allowing manual pumping from an associated oil containment device.

In accordance with another aspect of the present invention, the shut-off device is a solenoid valve.

In accordance with another aspect of the present invention, the solenoid opens to shut off flow of oil.

In accordance with another aspect of the present invention, the monitor further includes means for informing a user that the containment device is approximately ¾ full and means for informing the user that the containment device is substantially full.

In accordance with another aspect of the present invention, the device further includes an insulation housing, the insulation housing being of sufficient thickness to allow use of the containment device in temperatures down to approximately −10° F.

In accordance with another aspect of the present invention, the body is wrapped with a stainless steel skin, wherein a space between the body and the skin is approximately ½ inch.

In accordance with another aspect of the present invention, no insulation is used between the skin and the body.

In accordance with another aspect of the present invention, a waste oil storage caddy having a motor, a pump, and a power cord, the caddy including a body, an oil container, a filter, the filter located within the container, first tubing, the first tubing connected to the associated motor, second tubing, the second tubing connected to the motor and the oil container, and a cover for the container, the cover having a cut-out portion.

In accordance with another aspect of the present invention, a method for converting an oil filtration caddy, the caddy having a motor, a pump, a body, an oil container, a cover with a cut-out portion, and a filter, the method including the steps of rotating the pump approximately 90°, filtering used oil through the filter, and pumping the filtered oil into an associated fryer.

Still other benefits and advantages of the invention will become apparent to those skilled in the art upon reading and understanding of the following detailed specification.

III. BRIEF DESCRIPTION OF DRAWINGS

The invention is illustrated in the following drawings.

Figure 3A:
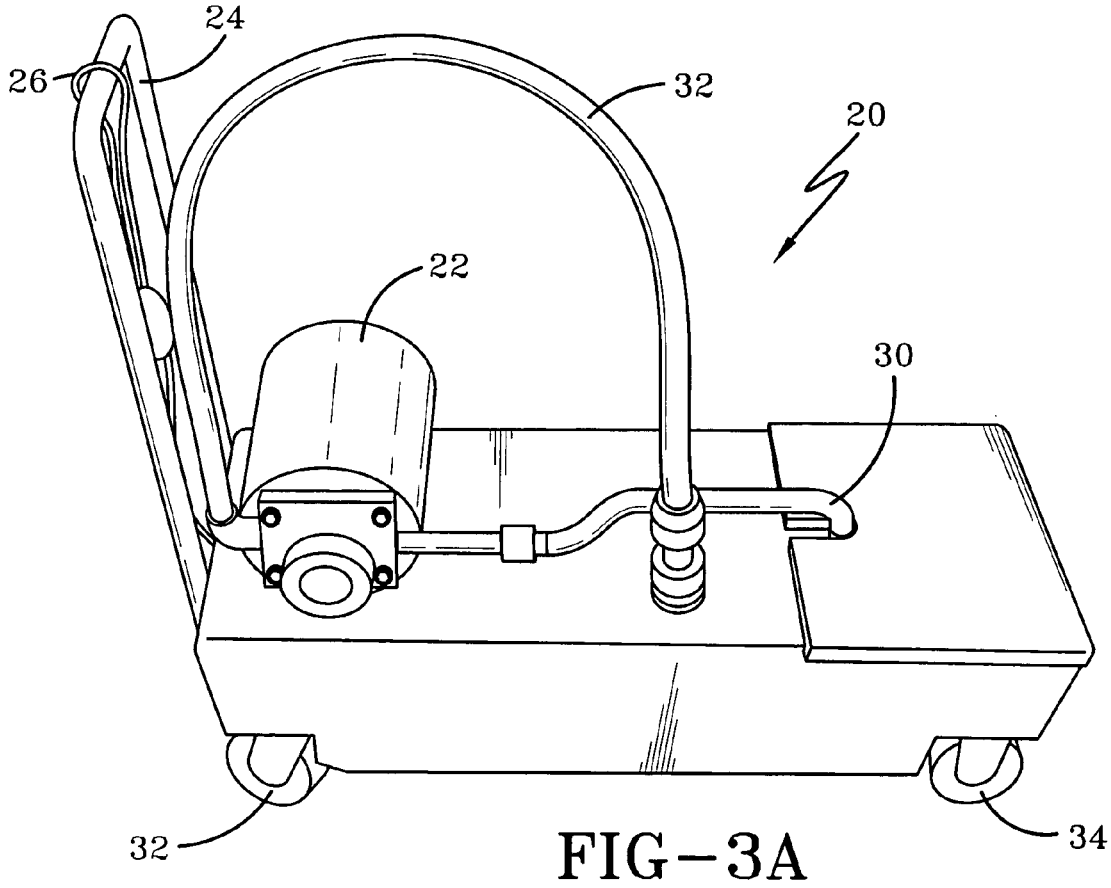
Figure 3B:
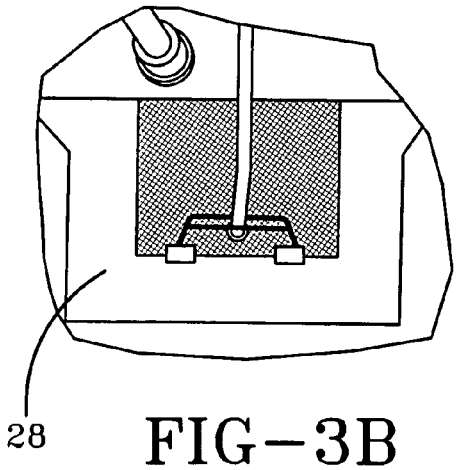
Figure 3C:
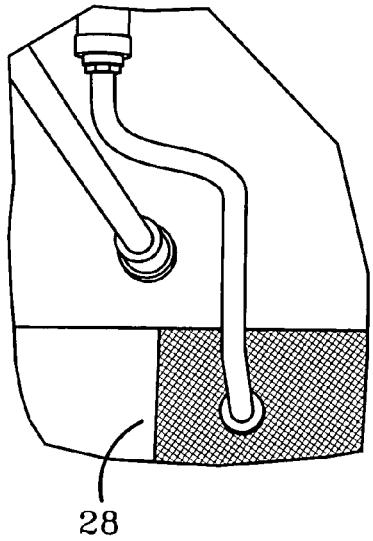
Figure 4:
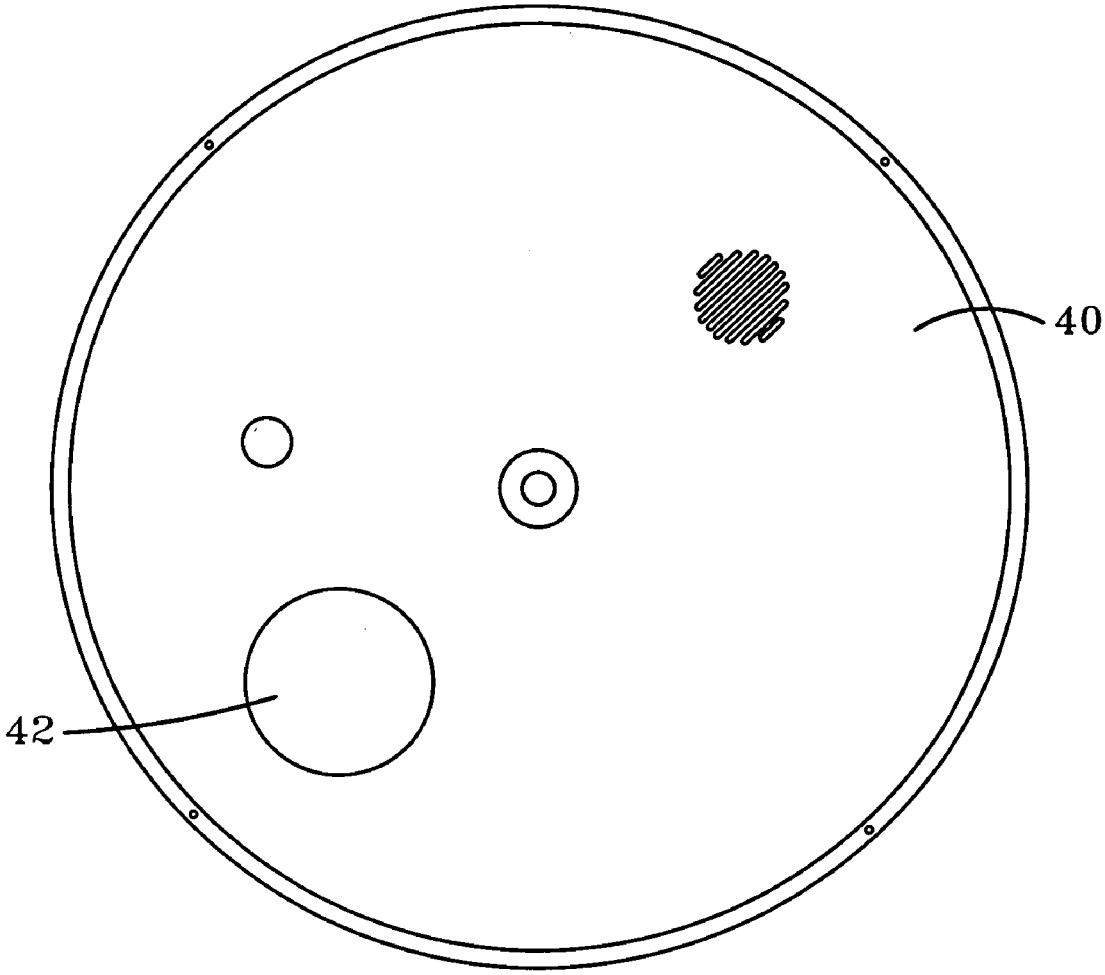
Figure 5:
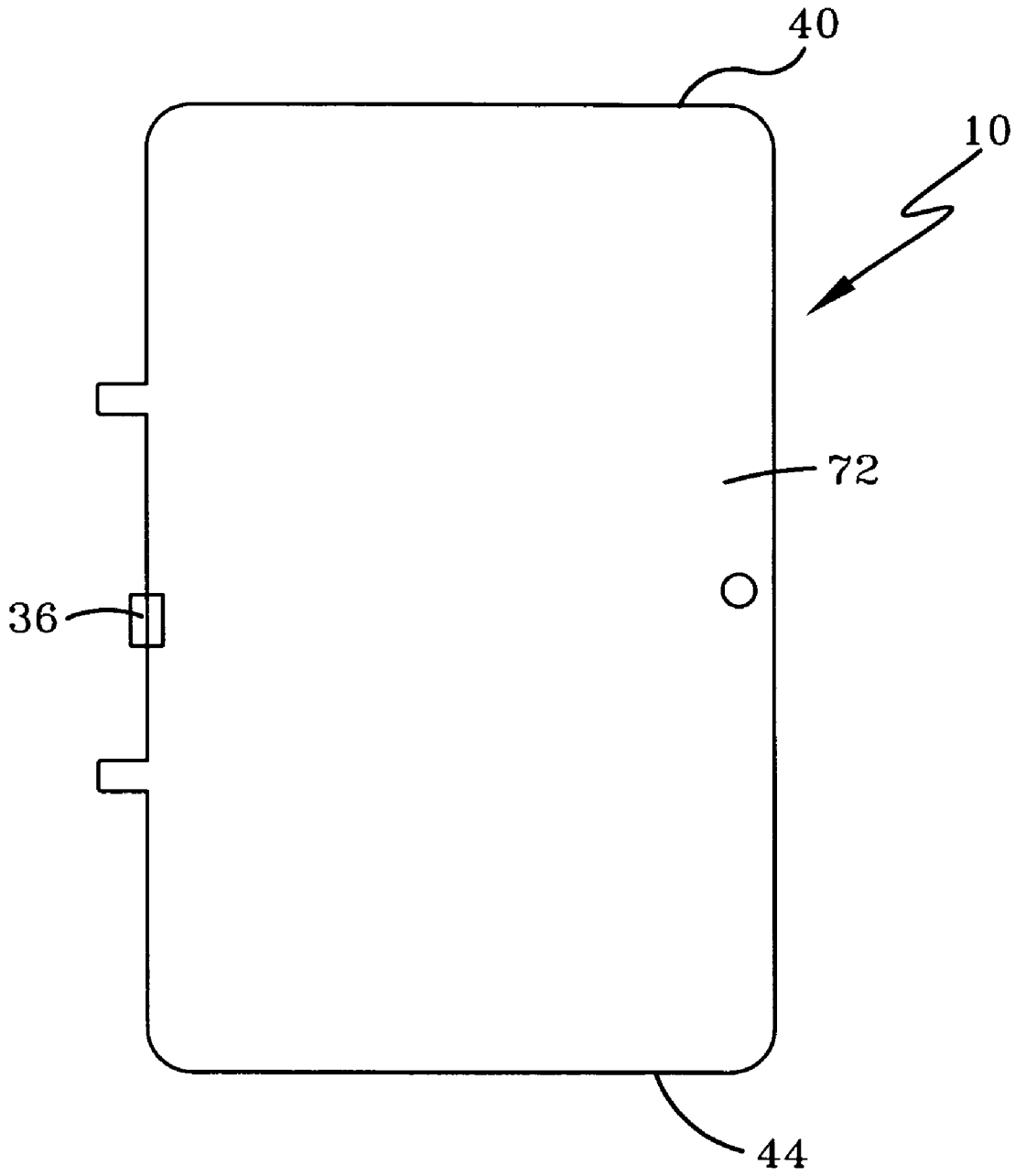
Figure 6:
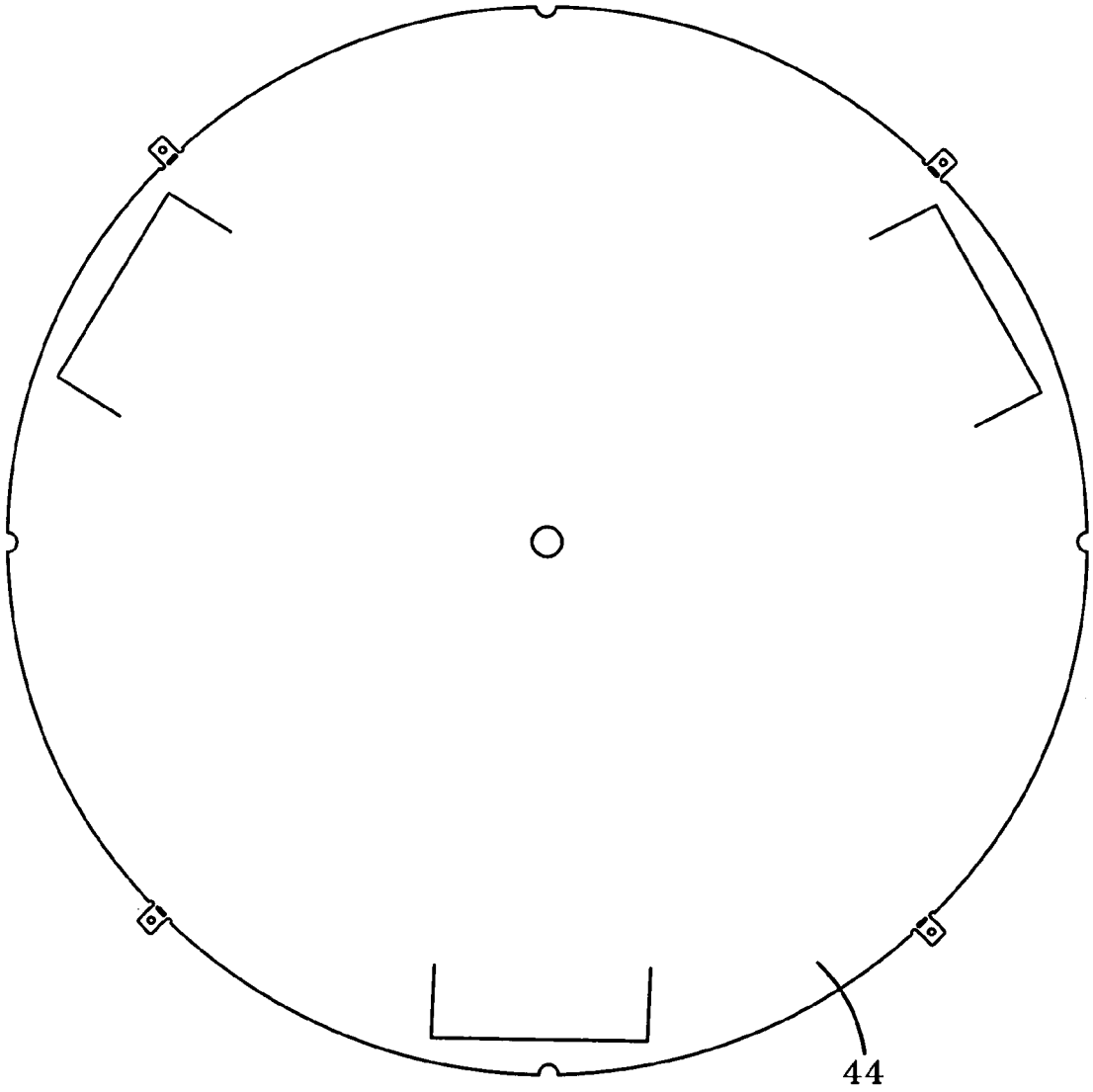
Figure 7:
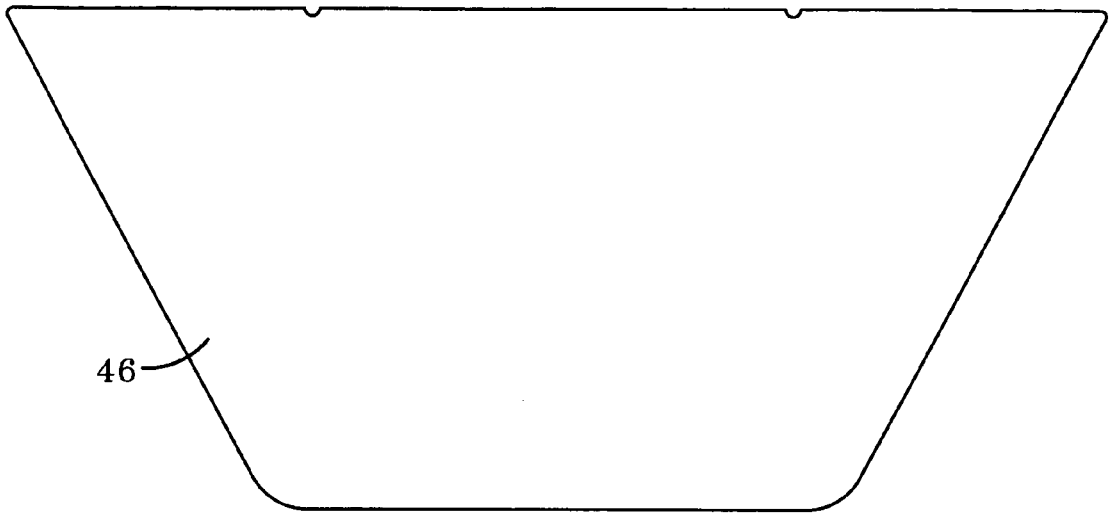
Figure 8:
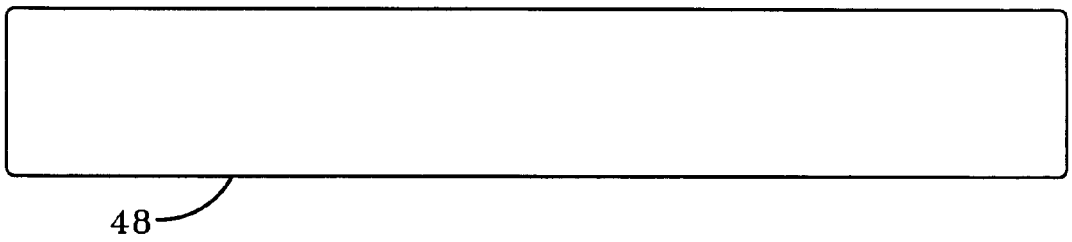
Figure 9:
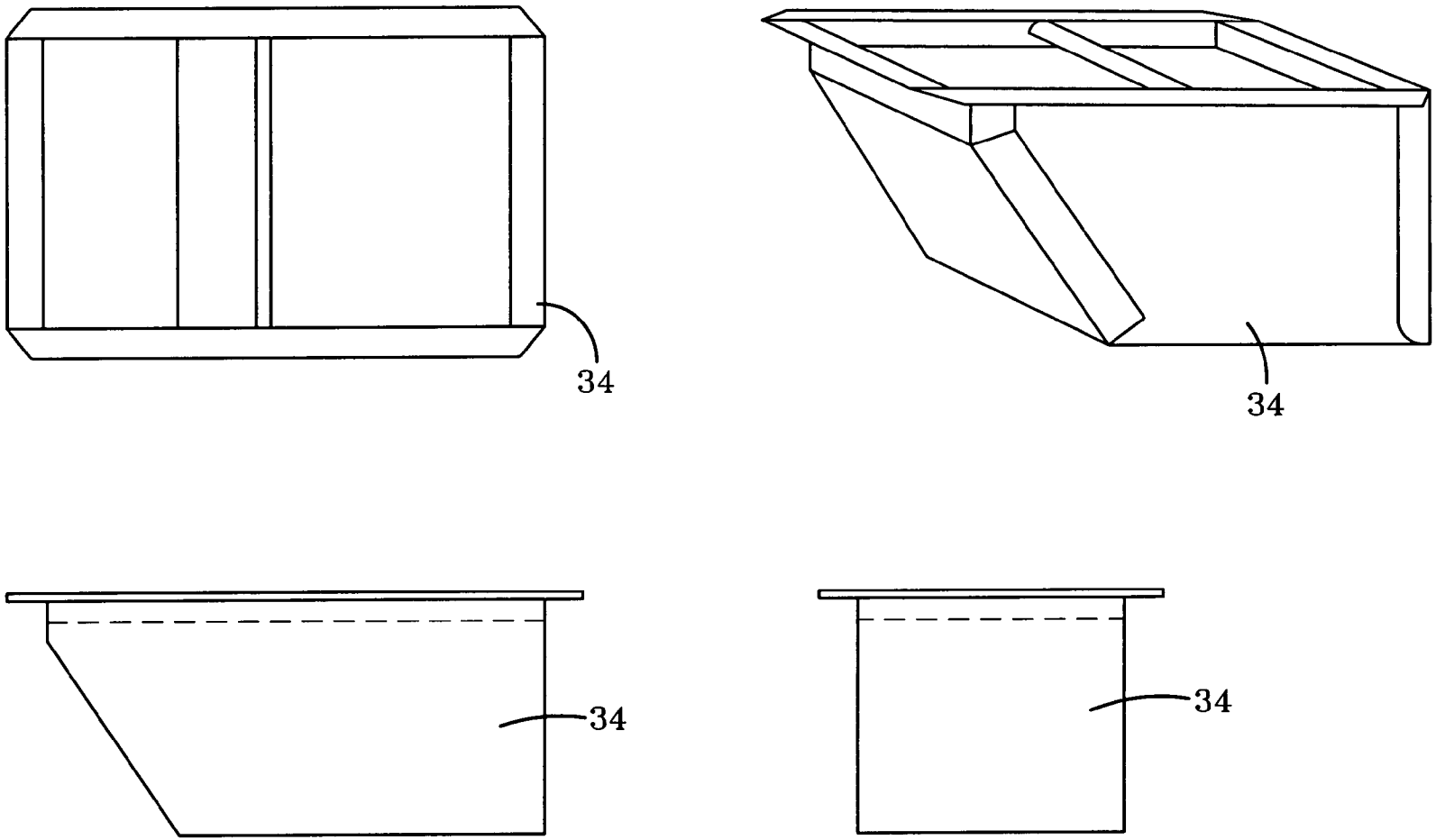
Figure 10:
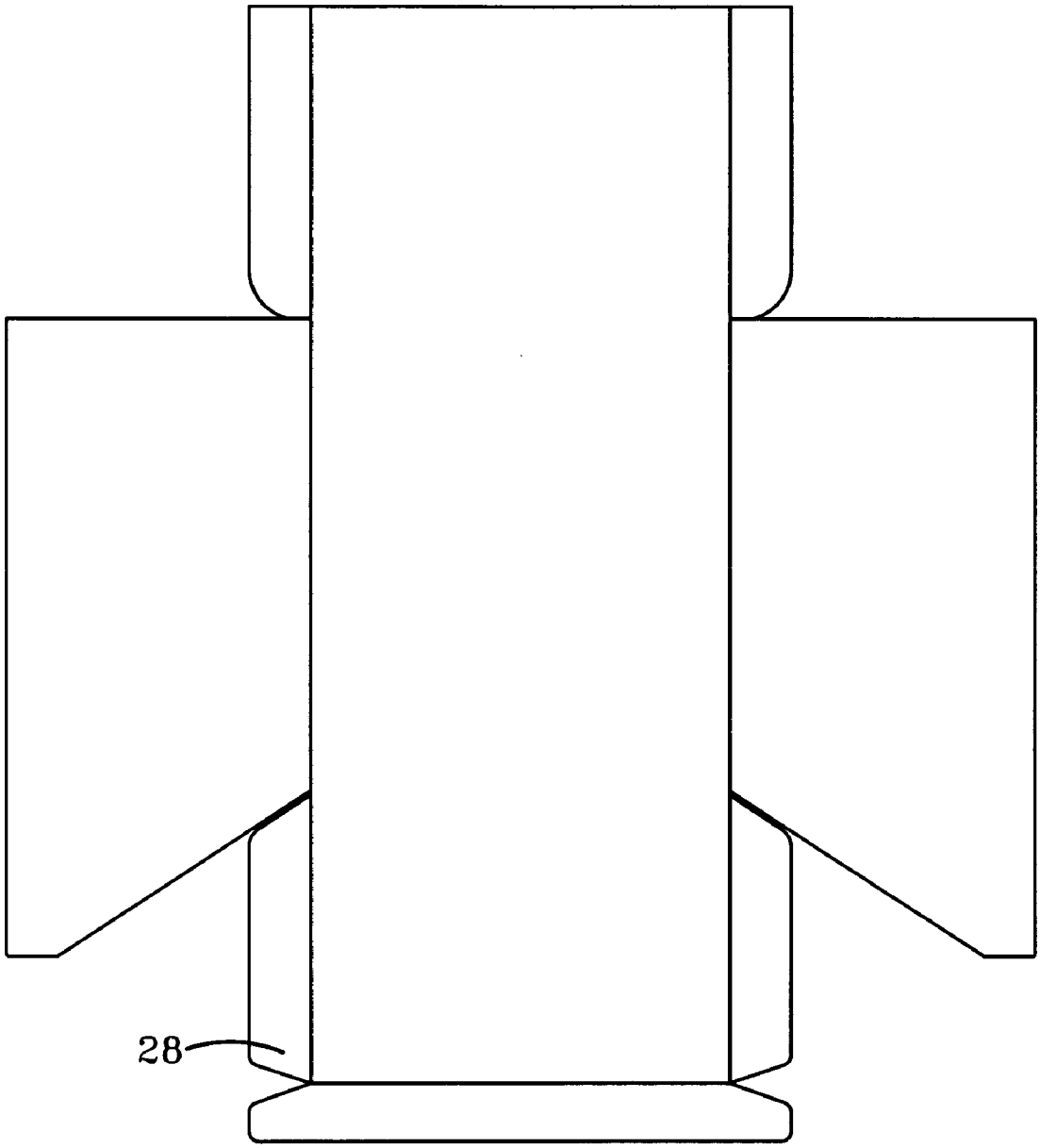
Figure 11:
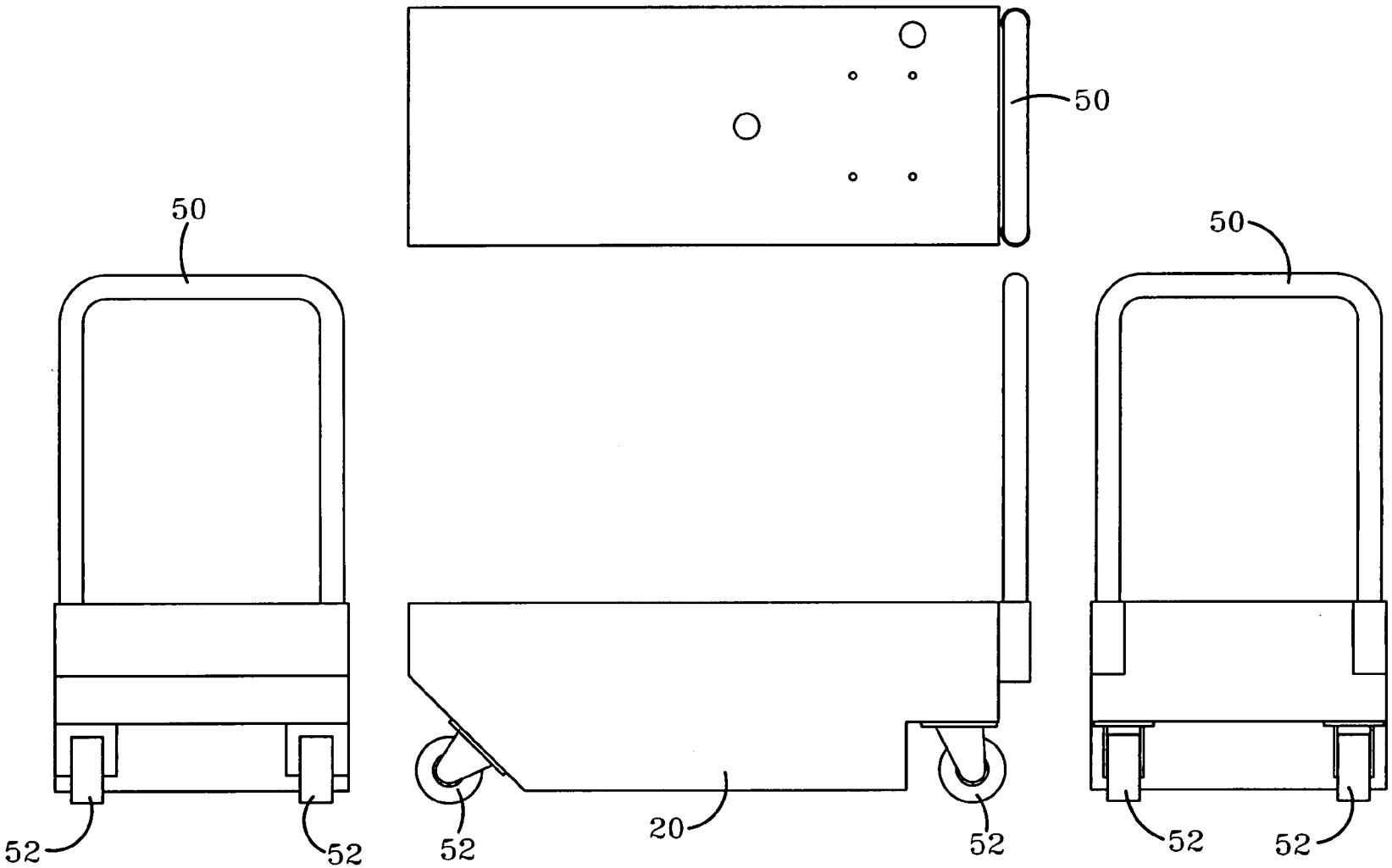
Figure 12:
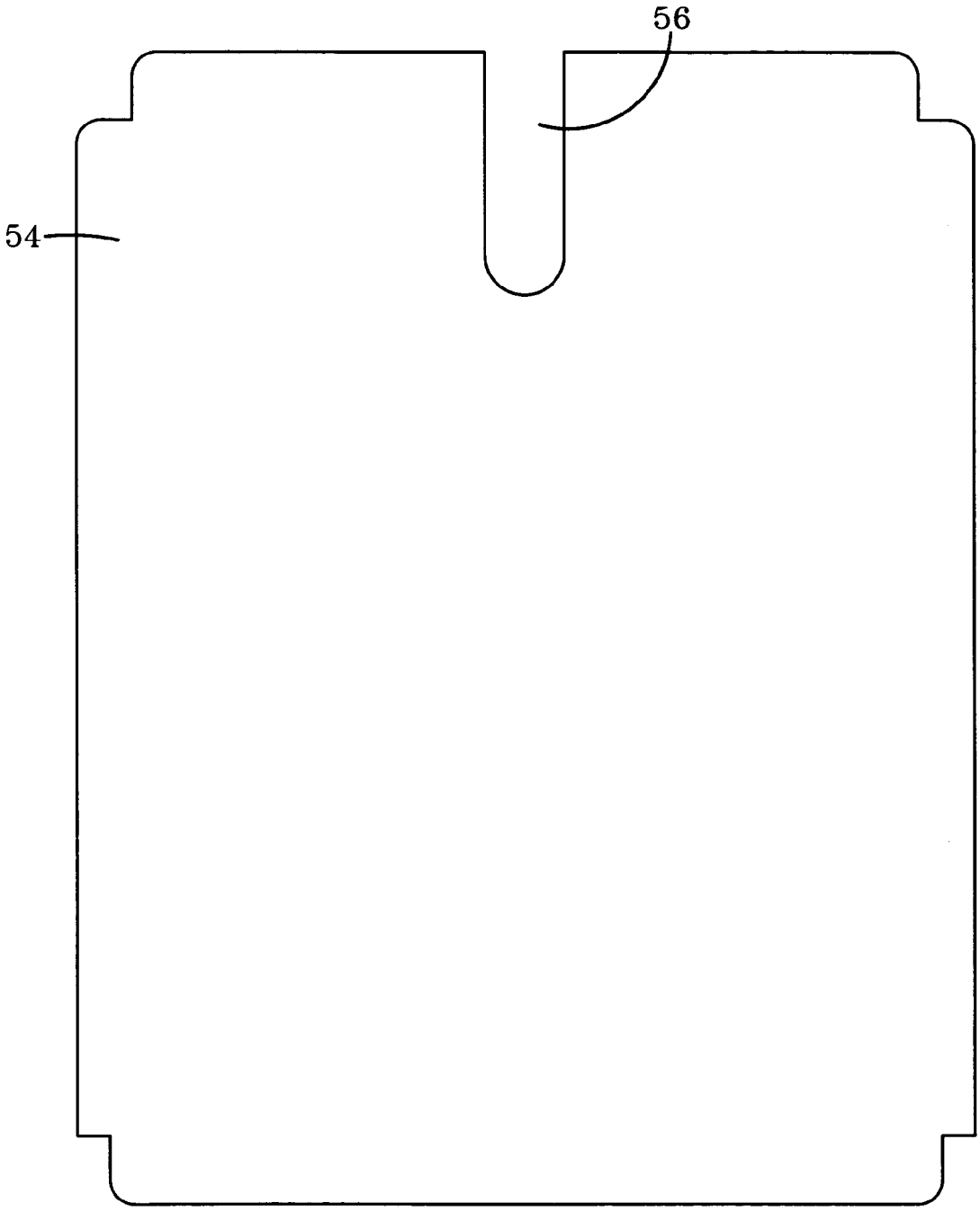
Figure 13:
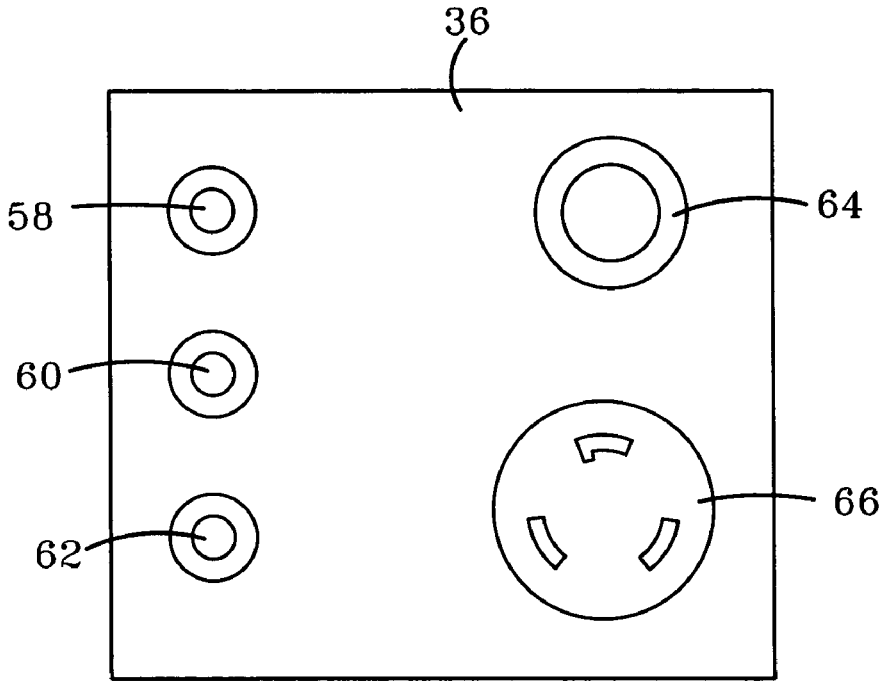
Figure 14:
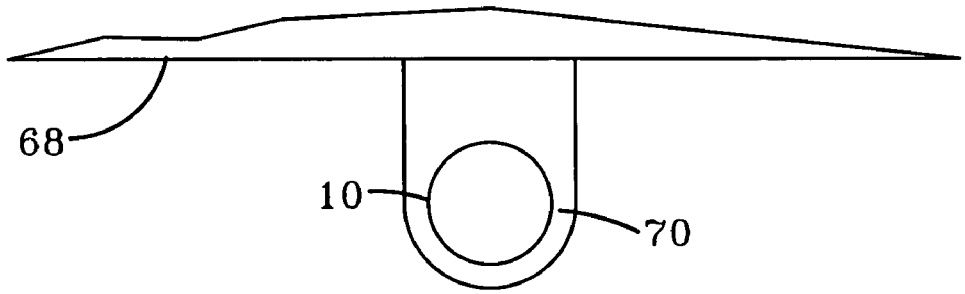

FIGS. 3A–C show a perspective view of the storage caddy and filtration system;

FIG. 4 is a top view of the top of the storage tank;

FIG. 5 is a side view of the storage tank;

FIG. 6 is a top view of the bottom of the storage tank;

FIG. 7 is a perspective view of the foot of the storage tank;

FIG. 8 is a perspective view of the basket;

FIG. 9 is top, front, side, and perspective views of the storage caddy;

FIG. 10 is a lay-out of the filter screen;

FIG. 11 is front, side, and top views of the storage caddy;

FIG. 12 is a top view of the cover for the storage caddy;

FIG. 13 is a front view of the control panel; and,

FIG. 14 is a top view of the outside tank and insulation wall.

IV. DESCRIPTION OF THE INVENTION

The present invention includes several different strategies for waste oil containment. For example, an inside system is designed for when plenty of interior floor space is available in the building, and outside system is designed where insufficient interior floor space is available, but has exterior non-public wall space available, and custom solutions can be designed for specific needs.

The following is description of some of the components used in the present invention:

Inside Tank—30" diameter tank, heated, insulated, stainless steel sides, top and bottom, vented, level sensing switch, electronic control panel designed to control all phases of the operation.

Remote Tank—same as inside tank with the ability to be placed anywhere in a building due to the unique abilities of the control panel and pumping station. Additionally, an insulated building can be placed around the tank to put it outside.

Storage Caddy—Stainless steel cart used to shuttle the used oil from the fryer to the tank. The caddy has a filter basket to protect the pump and prevent buildup in the tank, four castors, of which two are locking, a motor with a separate on/off switch, and a break-away cord. The caddy can interface with control panel listed above. The caddy may be used as the only method of placing oil in the tank or, if a "direct connect system" is installed, no caddy is necessary.

Direct connect system—Allows fryers to be hooked directly to a pipe manifold and pump oil directly into the tank via overhead plumbing which can be rigid or flexible. The tank has additional solenoid valves added to stop the flow of oil and ensure that the tank does not overfill. All connections are made with quick-disconnects.

Note that the system is modular and upgradeable. By modular and upgradeable, it is meant that a caddy system can be installed and later upgraded to a direct connect with the appropriate kit and installation.

Figure 1:
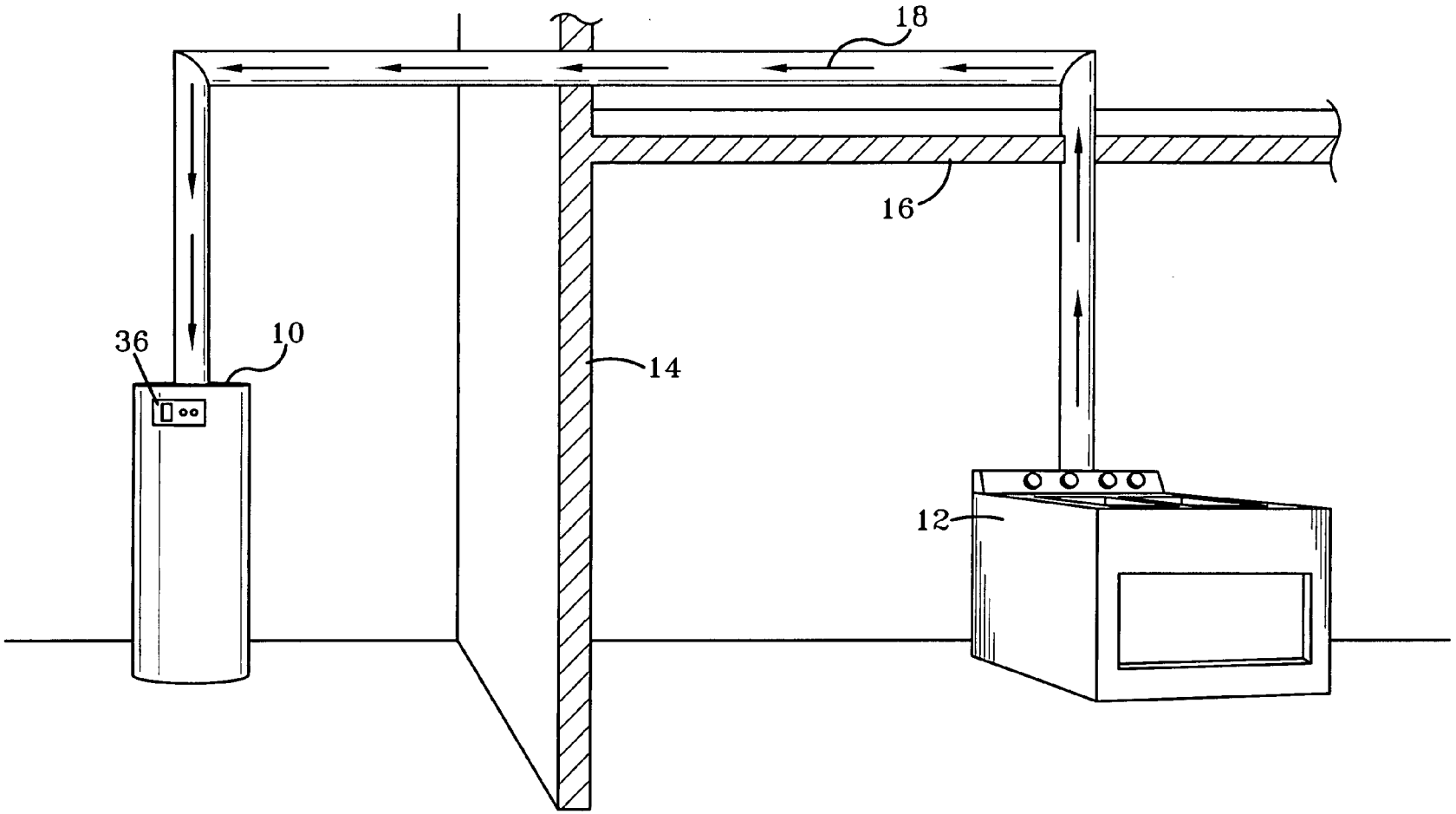
FIG. 1 is a perspective view of the inside direct plumbed system.

With reference now to FIG. 1, the inside direct plumbed system is shown. An associated oil utilizing apparatus 12, which in this particular embodiment is a deep fryer (it is to be understood that any device which uses food grade oil can be used with this invention), is located in a building. The fryer 12 is connected to a remote storage tank 10 by tubing 18. The direct plumbed system works best if the fryer 12 is equipped with a filtration system to filter the used oil before being pumped to the tank 10. As shown in FIG. 1, the tank 10 can be located on the other side of a wall 14 from the fryer 12, and the tubing 18 can travel through the wall 14 and a ceiling 16. It is to be understood that this is merely one embodiment of the invention, and the particular design and hook-up of the tubing 18 is not intended to limit the invention in any manner. Any tubing 18, tank 10, and fryer 12 design can be used, as long as chosen using sound engineering judgment. The tank 10 has a control panel 36, which allows the user to control the flow of oil from the fryer 12 into the tank 10. The system has a pumping mechanism (not shown) to pump the oil. The tank 10, as mentioned above has a sensing device (not shown), which enables the tank 10 to ensure that it is not overfilled. The control panel 36 and the tubing 18, allow the tank 10 to be set up anywhere in the building, as the pumping of the oil can be controlled remotely.

Figure 2:
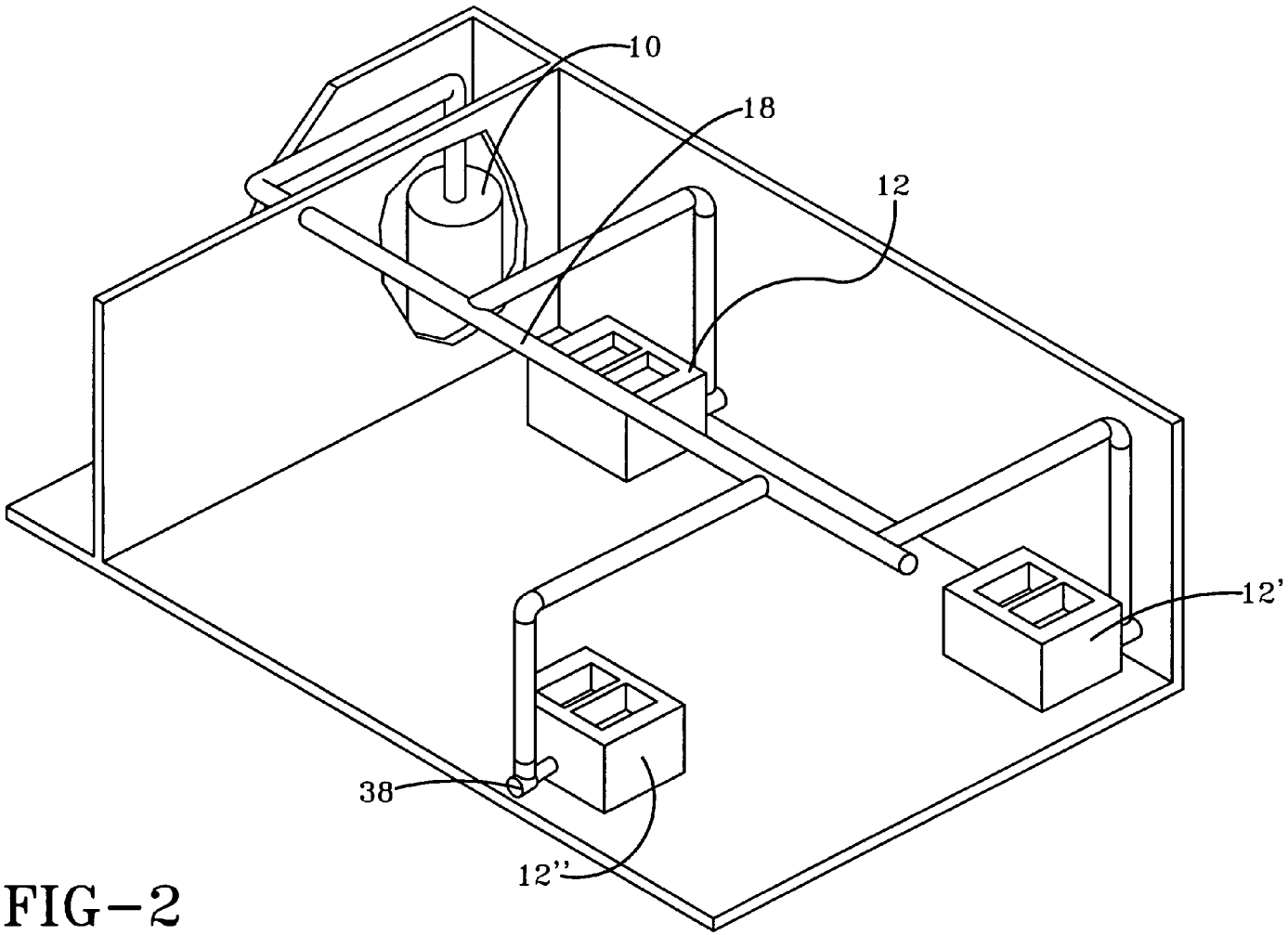
FIG. 2 is a perspective view of the outside direct plumbed system.

With reference now to FIG. 2, the outside direct plumbed system is shown. The outside direct plumbed system is similar to the inside direct plumbed system, except that the storage tank 10 is located outside the building. In FIG. 2, a multiple fryer 12, 12', 12" embodiment of the invention is shown as well (this embodiment can be used with both the inside and outside storage tanks 10). The fryers 12, 12', 12" are connected to the outside tank 10 via stainless steel tubing 18. The tubing 18, in this embodiment, is Teflon®-lined stainless steel hose. With the multiple fryers 12, 12', 12", a manifold bracket 38 is used to allow proper flow of oil to the tank 10.

With reference now to FIGS. 3A–C, a storage caddy 20 is shown. The storage caddy 20 is used to receive oil from the fryer 12 and transport the oil to a storage tank 10. In this embodiment, the caddy 20 is used in place of the direct plumbed systems. The caddy 20 has a handle 24, a detachable power cord 26, a motor/pump 22, a first container 32, a second container 34, a first tube 32, a second tube 30, and a filter 28. The first container 32 holds the used, non-filtered oil. Using a pumping mechanism 22 powered by the motor 22, the non-filtered oil is pulled up through the first tube 32 and into the second tube 30. The oil then passes over the filter 28. Any filter 28, or filtration system, can be used as long as chosen using sound engineering judgment. In this particular embodiment either Magnesol® XL, by The Dallas Group of Liberty Corner, New Jersey, or the Britesorb™ Oil Purifier, provided by The PQ Corporation of Valley Forge, Pennsylvania, is used. The storage caddy 20 allows the oil to be quickly and efficiently transported from the fryer 12 to the storage tank 10.

In another embodiment of this invention, an in-ground storage tank can be used. The design of the transport of the oil from the fryer to the tank is the same as any of the other embodiments, but the storage tank is located in the ground.

With reference now to FIGS. 1–7, 13, and 14 the storage tank 10 also has a top 40, opening 42, bottom 44, and foot 46. The control panel 36 has a power on light 58, a tank full light 60, a call for pickup light 62, a manual pump button 64, and an outlet 66. The control panel 36 can be used with the remote system, the storage caddy 20, and the direct plumb system. The fact that the control panel 36 is the same for all the systems allows for upgrades and interchange between the systems. The control panel 36 allows for the automatic shut-off of oil when the tank 10 becomes full. The flow of oil, in this embodiment, is stopped by a solenoid valve (not shown). The remote system can allow use of the storage tank 10 outside the associated facility. In this embodiment, the tank 10 has an insulated building 70, which surrounds the tank 10 and allows operation of the tank at temperatures of down to approximately −10° F. With the insulated building 70, the oil still maintains the necessary viscosity. It is to be understood that the solenoid valve is used to shut off the flow of oil in the direct plumb and remote systems, but when the oil is being pumped into the tank 10 directly through the spigot 74, the flow of oil is shut off via power interruption.

In this embodiment, the tank 10 has a stainless steel skin wrapped around the body 72 of the tank 10. There is approximately a ½ inch gap between the body 72 and the skin, thereby eliminating the need for insulation. Also, the stainless steel skin retains reflective heat as well.

With reference now to FIGS. 8–12, the storage caddy 20 has a basket assembly 34, a basket frame 48, a filter 28, a handle 50, wheels 52, a cover 54, and a cut-out portion 56 on the cover 54. The manual pump button 64 is used with the storage caddy 20 when pumping oil from the caddy 20. This prevents the pump 22 from being burned out. The storage caddy 20 can be upgraded to operate as a portable oil filter. This allows the user to filter and re-use the oil on site, near the fryer 12. The pump 22 is rotated approximately 90°, from a vertical position to a horizontal position. The oil is then pumped from the fryer 12 into the caddy 20. The oil is then filtered using the filter 28. In this particular embodiment, the filter 28 is stainless steel. It is to be understood, however, that a paper filter could be used as well. The oil filtration caddy 20 can be attached to the remote system or directly to the tank 10 or fryer 12.

It is to be understood that the dimensions provided within this application are merely intended to represent one embodiment of this invention, and are not intended to limit the invention in any manner.

What is claimed is:

1. A waste cooking oil containment device, the containment device comprising:

a top;

a bottom;

a body;

a waste cooking oil level measurement device;

an oil shut-off device, the shut-off device connected to the containment device; and, a control panel, wherein the control panel is selectively removable such that the control panel can be used on multiple types of containment devices, the control panel comprising:

a display monitor, the monitor displaying the waste cooking oil level in the containment device;

means for allowing manual pumping from an associated oil containment device, and wherein the control panel is interchangeable between a direct connect system, a remote system, and a storage caddy;

means for relaying a shut-off signal to the oil shut-off device; and, a power supply.

2. The device of claim 1, wherein the shut-off device is a solenoid valve.

3. The device of claim 2, wherein the solenoid opens to shut off flow of oil.

4. The device of claim 3, wherein the monitor further comprises:

means for informing a user that the containment device is approximately ¾ full; and, means for informing the user that the containment device is substantially full.

5. The device of claim 1, wherein the device further comprises:

an insulation housing, the insulation housing being of sufficient thickness to allow use of the containment device in temperatures down to approximately −10° F.

6. The device of claim 1, wherein the body is wrapped with a stainless steel skin, wherein a space between the body and the skin is approximately ½ inch.

7. The device of claim 6, wherein no insulation is used between the skin and the body.

* * * * *